United States Patent [19]

Ringel et al.

[11] Patent Number: 4,711,181

[45] Date of Patent: Dec. 8, 1987

[54] WARHEAD WITH ROTATIONALLY-SYMMETRICAL HOLLOW CHARGE

[75] Inventors: Konrad Ringel, Leinburg; Karl Rudolf, Schrobenhausen, both of Fed. Rep. of Germany

[73] Assignee: Diehl GmbH & Co., Nuremberg, Fed. Rep. of Germany

[21] Appl. No.: 937,221

[22] Filed: Dec. 3, 1986

[30] Foreign Application Priority Data

Dec. 18, 1985 [DE] Fed. Rep. of Germany ..... 3544747

[51] Int. Cl.[4] ..... F42B 3/08

[52] U.S. Cl. ..... 102/476; 102/309

[58] Field of Search ..... 102/305–310, 102/501, 475, 476

[56] References Cited

U.S. PATENT DOCUMENTS

| | | | |
|---|---|---|---|
| 2,809,585 | 10/1957 | Moses | 102/476 |
| 3,732,817 | 5/1973 | Thomanek | 102/305 |
| 3,736,875 | 6/1973 | Bucklishch | 102/309 |
| 3,877,376 | 4/1975 | Kupelian | 102/701 |
| 3,913,488 | 10/1975 | Dunetz et al. | 102/501 |
| 4,458,596 | 7/1984 | Armstrong . | |

FOREIGN PATENT DOCUMENTS

| | | |
|---|---|---|
| 3405527 | 2/1984 | Fed. Rep. of Germany . |
| 1359513 | 3/1964 | France . |
| 2158923 | 11/1985 | United Kingdom . |

*Primary Examiner*—Harold J. Tudor

*Attorney, Agent, or Firm*—Scully, Scott, Murphy & Presser

[57] ABSTRACT

A warhead which incorporates a rotationally-symmetrical hollow charge, and provides for a selectively centered or eccentric triggering thereof through the intermediary of suitably arranged detonators. Arranged symmetrically relative to the centrally-located detonator, are two further detonators in a principal plane. Through the symmetrical arrangement of two detonators outside of the principal axis of the warhead, there is generated an areal, cutting charge jet-like particle stream or jet, which will produce a line-like penetrating crater in the target at a relatively extensive penetrating depth.

1 Claim, 5 Drawing Figures

WARHEAD WITH ROTATIONALLY-SYMMETRICAL HOLLOW CHARGE

BACKGROUND OF THE INVENTION

1. Field of the Invention

The present invention relates to a warhead which incorporates a rotationally-symmetrical hollow charge, and provides for a selectively centered or eccentric triggering thereof through the intermediary of suitably arranged detonators.

2. Discussion of Prior Art

From the disclosure of copending and still unpublished German Patent Appln. No. P35 01 649, a warhead has become known, through the intermediary of which there can be attacked either thinly-armored or heavily-armored targets. For this purpose, in addition to the centrally-located detonator, there is provided at least one eccentrically-located detonator. Upon a triggering of the eccentric detonator being implemented, the hollow charge generates a whip-like jet. The particles of the insert which are accelerated by the explosive material will strike adjoiningly and in sequence against the target and produce therein a slit-like elongated hole. The penetrating action in the target which is achieved thereby is inadequate for combating helicopters and lightly-armored vehicles. For this purpose, it is necessary to achieve a greater penetrating effect in the target.

SUMMARY OF THE INVENTION

Accordingly, it is an object of the present invention to provide a warhead which, in addition to the attacking of armor, is also effective for the attacking of helicopters.

The foregoing object is achieved through the intermediary of a warhead possessing a rotationally-symmetrical hollow charge in which, arranged symmetrically relative to the centrally-located detonator, there are provided two further detonators in a principal plane.

Advantageous further features of the invention may be readily ascertained from the following detailed description. It is important to the invention that, through the symmetrical arrangement of two detonators outside of the principal axis of the warhead, there is generated an areal, cutting charge jet-like particle stream or jet, which will produce a line-like penetrating crater in the target at a relatively extensive penetrating depth.

Pursuant to a further feature of the invention, the action of the expanded or broadened jet is improved without any significant adverse influence over the hollow charge jet upon a central triggering of the detonator.

In accordance with another feature of the invention, there is produced a peripheral splinter or fragment formation caused by small projectiles; for instance, for effective action against the rotor blades of helicopters.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 2:
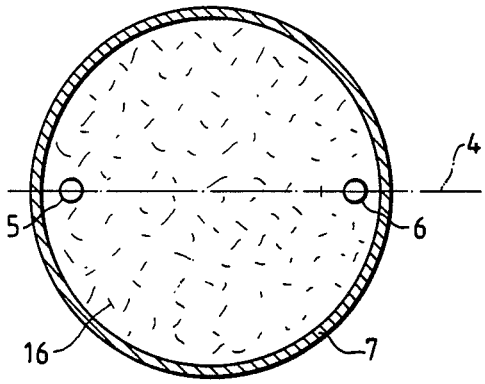
FIG. 2 illustrates a sectional view taken along line II—II in FIG. 1.
Figure 1:
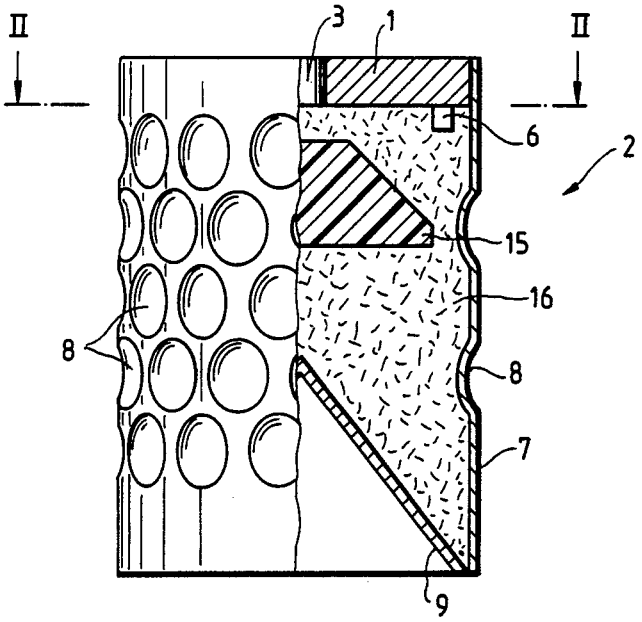
FIG. 1 illustrates a partially sectional longitudinal view through a warhead.

Arranged; for example, on a base plate 1 of a warhead 2, are a centrally-located detonator 3, and two eccentrically-located detonators 5, 6 in one plane 4, and a casing 7 with projectile-forming coverings 8. Fastened to the casing 7, in a known manner, is a jet-forming insert 9. A deflector member 15 is arranged within the explosive material 16.

Figure 3:
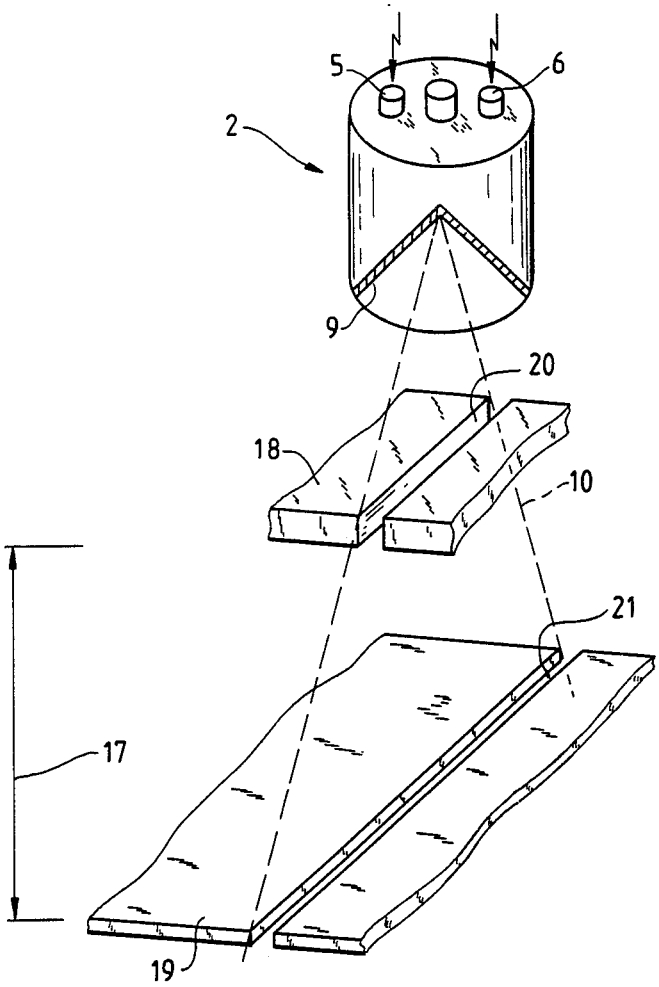
FIG. 3 illustrates a diagrammatic representation of the effect of the warhead of FIG. 1 upon an eccentric triggering.

In accordance with FIG. 3, upon the simultaneous triggering of the detonators 5, 6, there is present an extended jet 10, similar to the jet of a cutting charge.

This jet produces in a target possessing two steel plates 18, 19 which are arranged at a spacing 17 from each other (bulkheaded or compartmented target), the respective cuts 20, 21.

Figure 4:
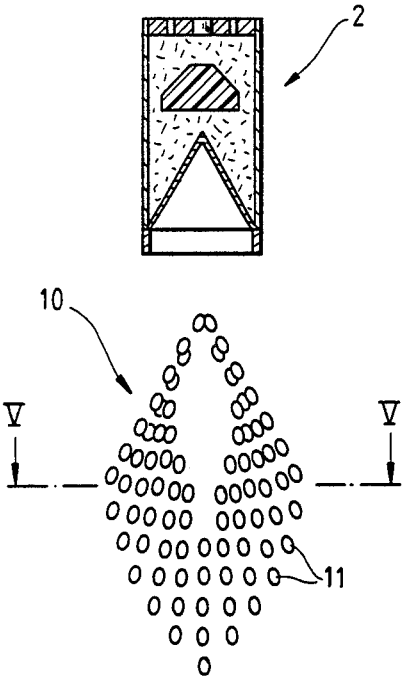
FIG. 4 illustrates a further diagrammatic representation of the arrangement of FIG. 3.
Figure 5:
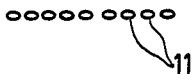
FIG. 5 illustrates a sectional view taken along line V—V in FIG. 4.

Pursuant to FIGS. 4 and 5, there can be ascertained the expanded jet 10, constituted of individual mass particles 11 transformed from the insert 9.

Directly proportional to the sequentially located mass particles 11, is the degree of effectiveness within the target. Hereby, as a result, there is achieved a relatively extensive penetrating depth into the target.

What is claimed is:

1. A warhead comprising a rotationally-symmetrical hollow charge with selective central or eccentric triggering through a plurality of predeterminately positioned detonators; said warhead including a generally cylindrical casing having projectile-forming coverings thereon; a base plate closing one end of said casing; a jet-forming insert closing the opposite end of said casing; an explosive material filling said casing and adapted to be triggered by said detonators; said plurality of detonators being arranged in said base plate and including a central detonator and two additional detonators symmetrically spaced relative to said central detonator in a central principal plane longitudinal extending through said casing; and a rotationally-symmetrical deflector member being centrally arranged within the explosive material.

* * * * *